US009283129B1

(12) United States Patent
Pifer et al.

(10) Patent No.: US 9,283,129 B1
(45) Date of Patent: Mar. 15, 2016

(54) RESCUE LIFE SYSTEM

(71) Applicants: Douglas R. Pifer, Dunedin, FL (US); Gregory A. Pifer, Valrico, FL (US)

(72) Inventors: Douglas R. Pifer, Dunedin, FL (US); Gregory A. Pifer, Valrico, FL (US)

( * ) Notice: Subject to any disclaimer, the term of this patent is extended or adjusted under 35 U.S.C. 154(b) by 0 days.

(21) Appl. No.: 14/726,718

(22) Filed: Jun. 1, 2015

Related U.S. Application Data

(63) Continuation-in-part of application No. 14/052,995, filed on Oct. 14, 2013, now abandoned.

(51) Int. Cl.

| | |
|---|---|
| ***A45F 4/06*** | (2006.01) |
| ***A61G 1/01*** | (2006.01) |
| ***A61G 1/044*** | (2006.01) |
| ***A47D 13/02*** | (2006.01) |

(52) U.S. Cl.
CPC ... *A61G 1/01* (2013.01); *A45F 4/06* (2013.01); *A47D 13/025* (2013.01); *A61G 1/044* (2013.01)

(58) Field of Classification Search
CPC ..... A61G 1/00; A47D 13/02; A47D 13/025; A45F 4/06; A45F 3/08
USPC ..... 224/158, 156
See application file for complete search history.

(56) References Cited

U.S. PATENT DOCUMENTS

| | | | | | |
|---|---|---|---|---|---|
| 2,788,530 | A | * | 4/1957 | Ferguson | 5/628 |
| 3,547,456 | A | * | 12/1970 | Sapp | 280/19 |
| 3,549,456 | A | * | 12/1970 | Warkoczewski et al. | 156/446 |
| 3,797,051 | A | * | 3/1974 | Evans | 5/627 |
| 3,829,914 | A | * | 8/1974 | Treat | 5/81.1 T |
| 4,124,908 | A | * | 11/1978 | Burns et al. | 5/628 |
| 4,132,427 | A | * | 1/1979 | McGee | 280/19 |
| 4,442,557 | A | * | 4/1984 | Clemens | 5/625 |
| 4,841,961 | A | * | 6/1989 | Burlage et al. | 128/876 |
| 5,050,254 | A | * | 9/1991 | Murphy | 5/625 |
| 5,121,514 | A | * | 6/1992 | Rosane | 5/628 |
| 5,150,487 | A | * | 9/1992 | Hemphill | 5/625 |
| 5,189,746 | A | * | 3/1993 | Horie | 5/627 |
| 5,720,303 | A | * | 2/1998 | Richardson | 128/870 |
| 5,729,850 | A | * | 3/1998 | Eskeli | 5/621 |
| 5,839,137 | A | * | 11/1998 | Butler et al. | 5/627 |
| 6,375,052 | B2 | * | 4/2002 | Keton | 224/222 |
| 6,851,145 | B2 | * | 2/2005 | Smith et al. | 5/627 |
| 6,859,960 | B1 | * | 3/2005 | Jerome | 5/413 R |
| 6,871,368 | B2 | * | 3/2005 | Calkin | 5/628 |
| 7,168,110 | B2 | * | 1/2007 | Girard et al. | 5/89.1 |
| 7,302,723 | B2 | * | 12/2007 | Dean | 5/627 |
| D589,849 | S | * | 4/2009 | Powell et al. | D12/128 |
| 7,607,184 | B1 | * | 10/2009 | Goodner, Jr. | 5/627 |
| D608,253 | S | * | 1/2010 | Giduck | D12/128 |
| 7,832,743 | B2 | * | 11/2010 | Small | 280/19 |
| 8,281,430 | B1 | * | 10/2012 | Hough et al. | 5/89.1 |
| 8,365,326 | B2 | * | 2/2013 | Kenalty et al. | 5/628 |
| 8,528,137 | B2 | * | 9/2013 | Johnson et al. | 5/628 |
| 8,793,827 | B1 | * | 8/2014 | Smart et al. | 5/627 |
| 8,936,253 | B1 | * | 1/2015 | Rizzi | 280/20 |

* cited by examiner

*Primary Examiner* — Justin Larson
*Assistant Examiner* — Lester L Vanterpool

(57) ABSTRACT

A lower sheet has lower front and rear edges separated by a lower length. The lower sheet has lower left and right edges separated by a lower width. Lateral straps are stitched to the lower sheet parallel with the lower front and rear edges. Longitudinal straps are stitched to the lower sheet parallel with the lower left and right edges. The longitudinal straps include an edge strap adapted to lie flat for receiving and discharging a patient and elevated for carrying the patient. An upper sheet has upper front and rear edges. A hard plastic sheet is removably received between the upper sheet and the lower sheet.

1 Claim, 3 Drawing Sheets

FIG. 5
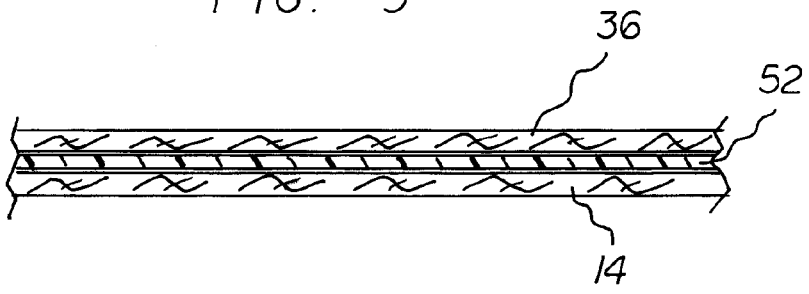
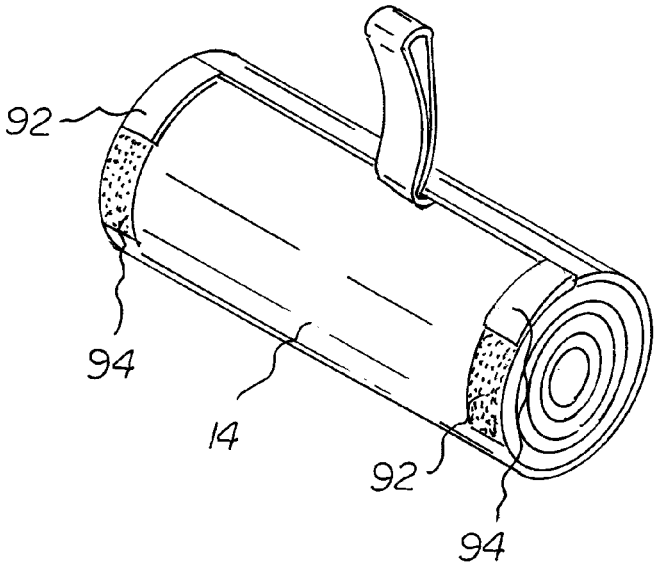
FIG. 6

RESCUE LIFE SYSTEM

RELATED APPLICATION

The present application is a continuation-in-part of pending application Ser. No. 14/052,995, filed Oct. 14, 2013, the subject matter of which is incorporated herein by reference.

BACKGROUND OF THE INVENTION

Field of the Invention

The present invention relates to a rescue lift system and more particularly pertains to supporting a patient and for transporting the supported patient to a location for treatment, the supporting and the transporting being done in a safe, convenient, and economical manner.

SUMMARY OF THE INVENTION

In view of the foregoing disadvantages inherent in the known types of lift system of known designs and configurations now present in the prior art, the present invention provides an improved rescue lift system. As such, the general purpose of the present invention, which will be described subsequently in greater detail, is to provide a new and improved rescue lift system and method which has all the advantages of the prior art and none of the disadvantages.

From a broad point of view, the present invention may be considered a rescue lift system comprising a lower sheet, a plurality of lateral straps, and upper sheet, and a hard plastic sheet. First, a lower sheet is provided. The lower sheet is in a rectangular configuration. The lower sheet has a lower front edge and a lower rear edge. The lower front edge and a lower rear edge are separated by a lower length. The lower sheet has a lower left edge and a lower right edge. The lower left edge and the lower right edge are separated by a lower width.

A plurality of lateral straps are provided. The straps are stitched to the lower sheet parallel with the lower front edge and the lower rear edge. A plurality of longitudinal straps are stitched to the lower sheet parallel with the lower left edge and the lower right edge. The plurality of longitudinal straps include an edge strap adapted to lie flat for receiving and discharging a patient. The edge strap is further adapted to be elevated for carrying the patient.

Further provided is an upper sheet. The upper sheet is in a rectangular configuration. The upper sheet has an upper front edge and an upper rear edge. The upper sheet has an upper left edge and an upper right edge.

Provided last is a hard plastic sheet. The hard plastic sheet is in a rectangular configuration. The hard plastic sheet is removably received between the upper sheet and the lower sheet.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved rescue lift system which has all of the advantages of the prior art lift system of known designs and configurations and none of the disadvantages.

It is another object of the present invention to provide a new and improved rescue lift system which may be easily and efficiently manufactured and marketed.

It is further object of the present invention to provide a new and improved rescue lift system which is of durable and reliable constructions.

An even further object of the present invention is to provide a new and improved rescue lift system which is susceptible of a low cost of manufacture with regard to both materials and labor, and which accordingly is then susceptible of low prices of sale to the consuming public, thereby making such rescue lift system economically available to the buying public.

Lastly, another object of the present invention is to provide a rescue lift system for supporting a patient and for transporting the supported patient to a location for treatment, the supporting and the transporting being done in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross sectional view taken along line 5-5 of FIG. 2.

FIG. 6 is a perspective view of the system of the present invention shown in an inoperative orientation for storage and transporting when not in use.

The same reference numerals refer to the same parts throughout the various Figures.

DESCRIPTION OF THE PREFERRED EMBODIMENT

Figures 1, 1A:
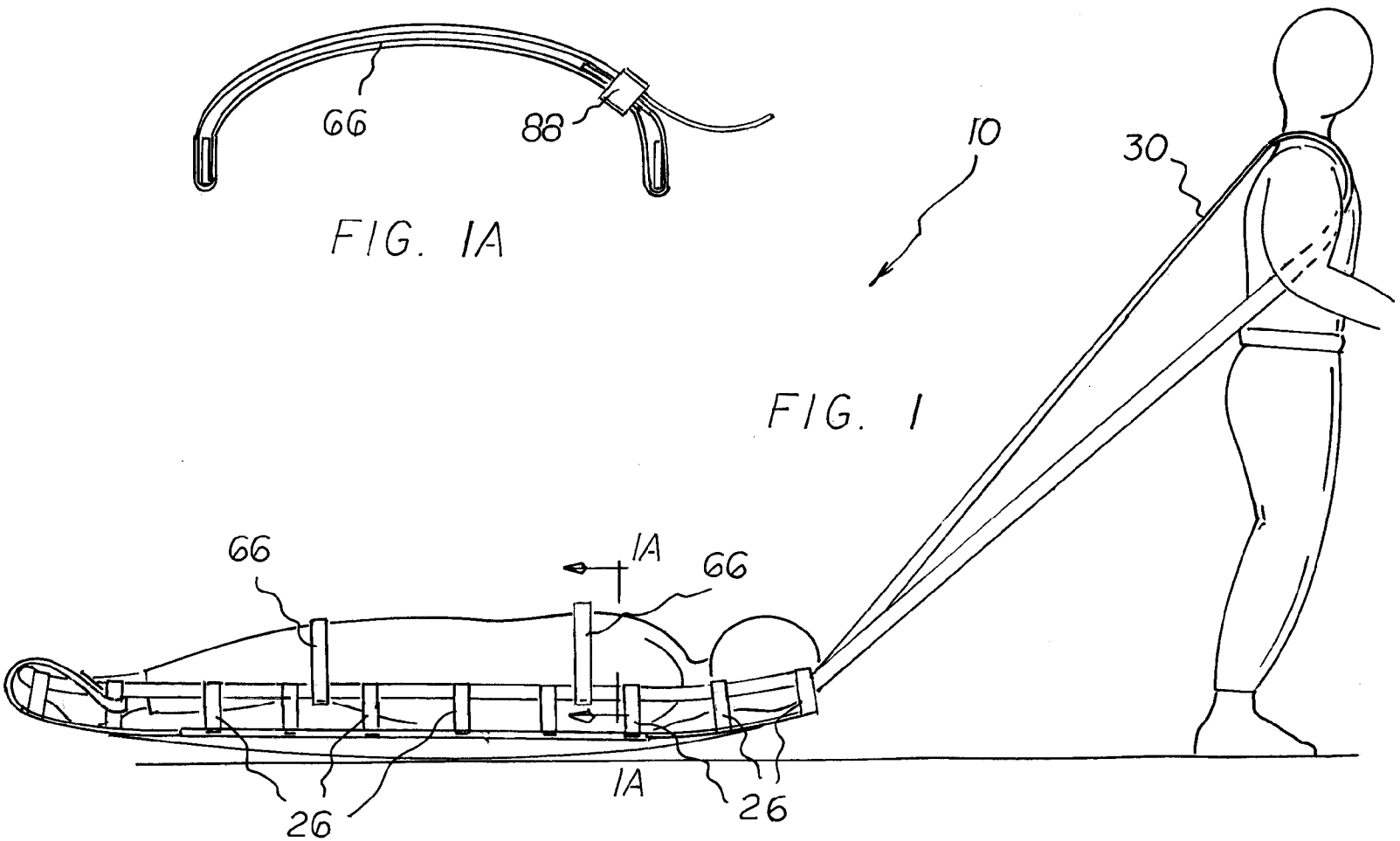
FIG. 1 is a side elevational view of the rescue lift system constructed in accordance with the principles of the present invention shown in use.
FIG. 1A is a cross sectional view taken along line 1A of FIG. 1 showing one of the retraining assemblies of the present invention in use.

With reference now to the drawings, and in particular to FIG. 1 thereof, the preferred embodiment of the new and improved rescue lift system embodying the principles and concepts of the present invention and generally designated by the reference numeral 10 will be described.

The present invention, the rescue lift system 10 is comprised of a plurality of components. Such components in their broadest context include a lower sheet, a plurality of lateral straps, an upper sheet, and a hard plastic sheet. The components are individually configured and correlated with respect to each other so as to attain the desired objective.

From a more specific point of view, the present invention is a rescue lift system. First provided is a lower sheet 14 in a rectangular configuration. The lower sheet has a lower front edge 16 and a lower rear edge 18. The lower front edge and the lower rear edge are separated by a lower length. The lower length is 80 inches plus or minus 10 percent. The lower sheet also has a lower left edge 20 and a lower right edge 22. The lower left edge and the lower right edge are separated by a lower width. The lower width is 15 inches plus or minus 20 percent.

Figures 2, 3, 4:
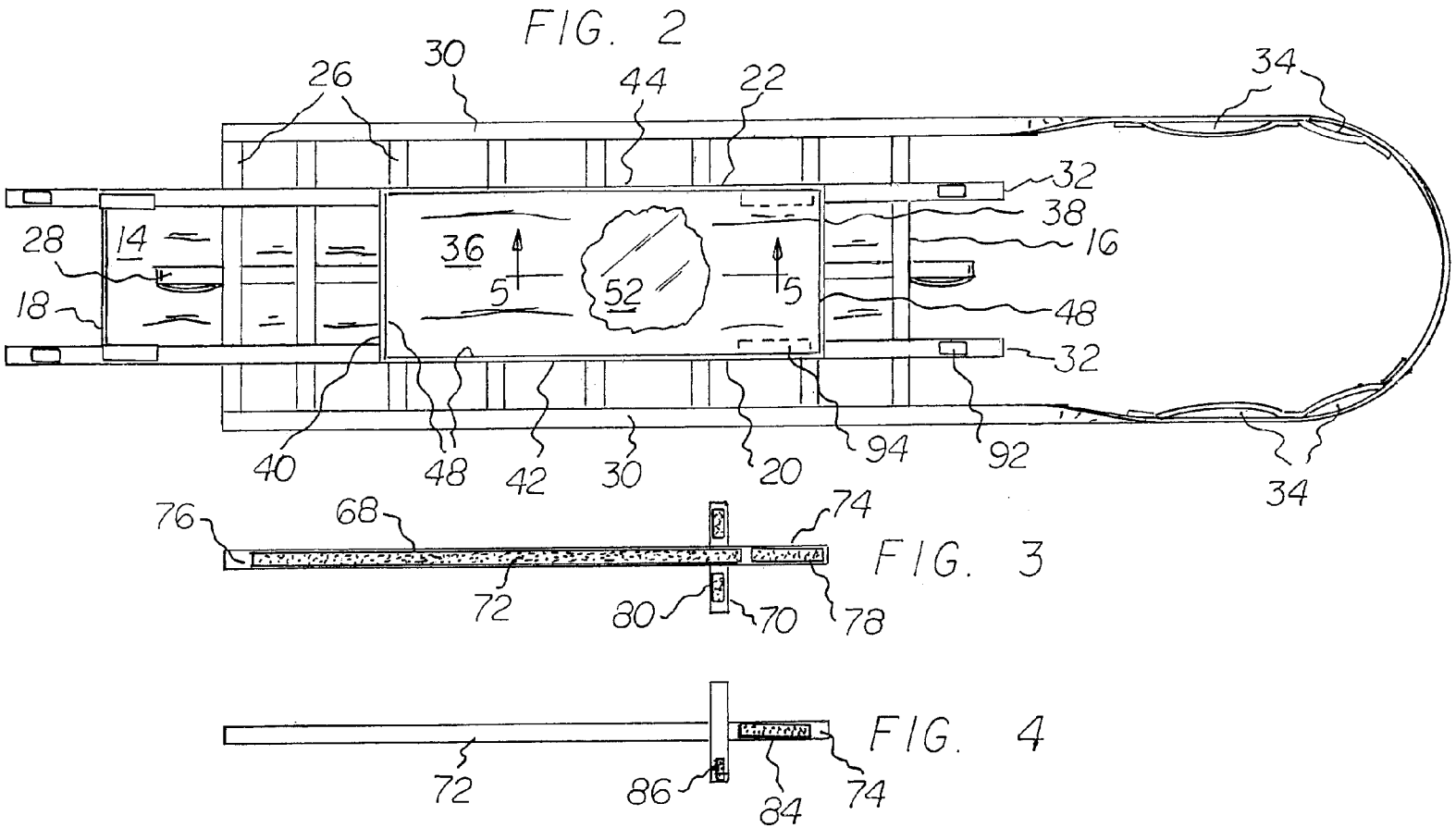
FIG. 2 is a top view of the system of the present invention.
FIG. 3 is a top view of one of the restraining assemblies of the present invention.
FIG. 4 is a bottom view of one of the restraining assemblies of the present invention.

Eight lateral straps 26 are provided. The lateral straps are stitched to the lower sheet. The lateral straps are parallel with the lower front edge and the lower rear edge. Each of the eight lateral straps has a width. The width is 2 inches plus or minus 25 percent. The eight lateral straps are equally spaced with respect to each other. The lower sheet has a plurality of longitudinal straps 28, 30, 32. The longitudinal straps are stitched to the lower sheet parallel with the lower left edge and the lower right edge. Each of the longitudinal straps has a width. The width is 2 inches plus or minus 25 percent. Each of the longitudinal straps are equally spaced with respect to each other. The plurality of longitudinal straps includes a central strap 28. The central strap has a length. The length is 84 inches plus or minus 20 percent. The plurality of longitudinal straps includes an edge strap 30. The edge strap has a length of 270 inches plus or minus 10 percent. The plurality of longitudinal straps includes two intermediate straps 32. Each intermediate strap has a length of 96 inches plus or minus 20 percent. The edge strap has overlapping straps. The overlapping straps have central loops 34. In this manner dragging is facilitated. The edge strap is adapted to lie flat with the central strap and intermediate straps. In this manner a patient is received and discharged. Note FIG. 2. The edge strap is adapted to be elevated above the central strap and intermediate straps. In this manner the patient is carried. Note FIG. 1.

Also provided is an upper sheet 36. The upper sheet is in a rectangular configuration. The upper sheet has an upper front edge 38 and an upper rear edge 40. The front edge and the rear edge are separated by an upper length of 65 inches plus or minus 10 percent. The front edge and the rear edge have an upper left edge 42. The front edge and the rear edge have an upper right edge 44. The upper left edge and the upper right edge are separated by an upper width of 18 inches plus or minus 10 percent.

Provided next is stitching 48. The stitching couples the upper sheet to the lower sheet. The upper sheet is coupled to the lower sheet at the upper front edge, at the upper rear edge, and at the upper left edge. In this manner a pocket is formed between the upper sheet and the lower sheet.

Further provided is a hard plastic sheet 52. The hard plastic sheet is in a rectangular configuration. The hard plastic sheet is removably received in the pocket between the upper sheet and the lower sheet. In this manner back support for a patient resting on the upper sheet and the lower sheet and to facilitate dragging.

Provided last are two restraining assemblies 66. Each restraining assembly is in a cross shaped configuration. The restraining assemblies include a primary component 68 and a secondary component 70. The secondary component has a center. The center is stitched to the primary component. In this manner the primary component is divided into a long section 72 and a short section 74. The long section is 53 inches plus or minus 20 percent in length. The short section is 8 inches plus or minus 20 percent in length. Each restraining assembly has a front face. The front face has front hook and loop fasteners 76, 78. The hook and loop fasteners are provided on the primary component. The secondary component also has front hook and loop fasteners 80. Each restraining assembly has a rear face. The rear face has rear hook and loop fasteners 84, 86. The rear face covers the short section and the secondary component to one side of the center. The primary component of each restraining assembly is looped around the edge strap adjacent to the lower left edge of the lower sheet and the lower right edge of the lower sheet. In this manner a patient is held on the upper sheet and the lower sheet. The secondary component forms a loop. The loop functions as a keeper 88. The secondary component further has securement hook and loop fasteners 92, 94. The securement hook and loop fasteners are adapted to hold the system rolled up when not in use.

Alternately, the present invention includes a restraining assembly in a cross-shaped configuration. The restraining assembly has a primary component and a secondary component. The secondary component has a center stitched to the primary component dividing the primary component into a long section and a short section. The restraining assembly has a front face. The front face of the primary component has front hook and loop fasteners. The front face of the secondary component also has hook and loop fasteners. Each restraining assembly has a rear face. The rear hook and loop fasteners cover the short section of the primary component and the secondary component to one side of the center.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A rescue lift system (10) for supporting a patient and for transporting the supported patient to a location for treatment, the supporting and the transporting being done in a safe, convenient, and economical manner, the system comprising, in combination:

a lower sheet (14) having a rectangular configuration with a lower front edge (16) and a lower rear edge (18) separated by a lower length of 80 inches plus or minus 10 percent, the lower sheet also having a lower left edge (20) and a lower right edge (22) separated by a lower width of 15 inches plus or minus 20 percent;

eight lateral straps (26) stitched to the lower sheet parallel with the lower front edge and the lower rear edge, each of the eight lateral straps having a width of 2 inches plus or minus 25 percent, the eight lateral straps being equally space with respect to each other, a plurality of longitudinal straps (28), (30), (32) stitched to the lower sheet parallel with the lower left edge and the lower right edge, each of the plurality of longitudinal straps having a width of 2 inches plus or minus 25 percent and equally spaced with respect to each other, the plurality of longitudinal straps including a Central strap (28) having a length of 84 inches plus or minus 20 percent, an edge strap (30) having a length of 70 inches plus or minus 10 percent, two intermediate straps (32) each having a length of 96 inches plus or minus 20 percent, the edge strap being formed of overlapping straps with central loops (34) to facilitate dragging, the edge strap adapted to lie flat with the central strap and intermediate straps for receiving and discharging a patient, the edge strap being elevated above the central strap and intermediate straps for carrying the patient, and with the central strap and the intermediate straps being fixed in a common plane;

an upper sheet (36) having a rectangular configuration with an upper front edge (38) and an upper rear edge (40) separated by an upper length of 48 inches plus or minus 10 percent and with an upper left edge (42) and an upper right edge (44) separated by an upper width of 15 inches plus or minus 20 percent;

stitching (48) coupling the upper sheet at the upper front edge and at the upper rear edge and at the upper left edge to the lower sheet thereby forming a pocket between the upper sheet and the lower sheet;

a hard plastic sheet (52) in a rectangular configuration removably received in the pocket between the upper sheet and the lower sheet to provide back support for a patient resting on the upper sheet and the lower sheet and to facilitate dragging, the central strap and the intermediate straps being beneath and coupled to the lower sheet and hard plastic sheet; and two restraining assemblies (66), each restraining assembly having a cross shaped configuration with a primary component (68) and a secondary component (70), the secondary component having a center stitched to the primary component dividing the primary component into a long section (72) and a short section (74), the long section being 53 inches plus or minus 20 percent in length, the short section being 8 inches plus or minus 20 percent in length, each restraining assembly having a front face with front hook and loop fasteners (76), (78) on the primary component and with front hook and loop fasteners (80) on the secondary component, each restraining assembly having a rear face with rear hook and loop fasteners (84), (86) covering the short section and the secondary component to one side of the center, the primary component of each restraining assembly being looped around the edge strap adjacent to the lower left edge of the lower sheet and the lower right edge of the lower sheet to hold a patient on the upper sheet and the lower sheet, the secondary component forming a loop for functioning as a keeper (88), securement hook and loop fasteners (92), (94) adapted to hold the system rolled up when not in use.

* * * * *

UNITED STATES PATENT AND TRADEMARK OFFICE

CERTIFICATE OF CORRECTION

PATENT NO. : 9,283,129 B1
APPLICATION NO. : 14/726718
DATED : March 15, 2016
INVENTOR(S) : Douglas R. Pifer and Gregory A. Pifer It is certified that error appears in the above-identified patent and that said Letters Patent is hereby corrected as shown below:

Title Page, Item 54 is corrected from "Rescue Life System" to --Rescue Lift System--.

Signed and Sealed this
Ninth Day of August, 2016

Michelle K. Lee

Michelle K. Lee
*Director of the United States Patent and Trademark Office*